US010064480B2

(12) United States Patent
Lee

(10) Patent No.: US 10,064,480 B2
(45) Date of Patent: Sep. 4, 2018

(54) PROCESS FOR PRODUCING AN OVERMOLDED BRUSH STRIP

(71) Applicant: Fook Yuen Lee, Senai (MY)

(72) Inventor: Fook Yuen Lee, Senai (MY)

( * ) Notice: Subject to any disclaimer, the term of this patent is extended or adjusted under 35 U.S.C. 154(b) by 31 days.

(21) Appl. No.: 15/129,192

(22) PCT Filed: Mar. 24, 2015

(86) PCT No.: PCT/MY2015/050017
§ 371 (c)(1),
(2) Date: Sep. 26, 2016

(87) PCT Pub. No.: WO2015/147631
PCT Pub. Date: Oct. 1, 2015

(65) Prior Publication Data

US 2017/0099937 A1 Apr. 13, 2017

(30) Foreign Application Priority Data

Mar. 24, 2014 (MY) ..... PI 2014700697

(51) Int. Cl.
*A46B 3/04* (2006.01)
*A46D 1/00* (2006.01)

(52) U.S. Cl.
CPC . *A46B 3/04* (2013.01); *A46D 1/00* (2013.01)

(58) Field of Classification Search
CPC ..... A46B 3/04; A46D 1/00
See application file for complete search history.

(56) References Cited

U.S. PATENT DOCUMENTS 4,133,147 A 1/1979 Swift, Jr.
2004/0180595 A1 9/2004 Arold-Gorham

FOREIGN PATENT DOCUMENTS

| | | | |
|---|---|---|---|
| CN | 101252866 | 8/2008 | |
| GB | 1457074 | 12/1976 | |
| JP | 2001070050 | 3/2001 | |
| JP | 2004109216 | 4/2004 | |
| JP | 2013027651 | 2/2013 | |
| WO | WO 2013124422 A1 * | 8/2013 | ..... B29C 45/14385 |

OTHER PUBLICATIONS

International Preliminary Report on Patentability Dated Aug. 31, 2016.
Written Opinion of the International Searching Authority Dated Jul. 13, 2015.
International Search Report Dated Jul. 28, 2015.
English Abstract of CN 101252866.
English Abstract of JP 2004109216.
English Abstract of JP 2001070050.
English Abstract of JP 2013027651.

* cited by examiner

*Primary Examiner* — Shay Karls
(74) *Attorney, Agent, or Firm* — Rahman LLC

(57) ABSTRACT

A process for producing a brush strip 1, comprises the steps of arranging a plurality of aligned monofilament fibers 2 transversely in a sinusoidal configuration to form a body portion 3 with fibers arranged in parallel and two looped ends 4*a*, 4*b*; applying at least one row of stitching 5 across the body portion towards one end, wherein the stitching is such as loop around groups of fibers to divide the body portion 3 into separate bundles; overmolding the stitched end of the bundles with a thermoplastic polymeric material 6; and trimming the non-overmolded end of the body portion 2 to create tufts of bristles 7.

11 Claims, 4 Drawing Sheets

PROCESS FOR PRODUCING AN OVERMOLDED BRUSH STRIP

CROSS-REFERENCE TO RELATED APPLICATION

The instant application is a national phase of PCT International Patent Application Serial No. PCT/MY2015/050017 filed Mar. 24, 2015, and claims priority to Malaysian Patent Application Serial No. PI 2014700697, filed Mar. 24, 2014, the entire specifications of both of which are expressly incorporated herein by reference.

FIELD OF INVENTION

The present invention relates to a process for producing a brush strip, and more particularly overmolding brush strip using injection molding method.

BACKGROUND OF THE INVENTION

Brush strips are widely used in cleaning and printing equipments. Nozzles of vacuum cleaners are often equipped with brush strips which aids in the removal of dirt, debris, lint, etc from a surface. Also, brush strips are used in printers to dissipate static charges built on the papers in order to prevent paper jams and produce printouts without smear.

There are some patented technologies over the prior art relating to brush strip. A brush strip of a vacuum cleaner nozzle having rows of spaced-apart synthetic filaments was disclosed in a China Patent No. 101252866. Nevertheless, there is no teaching provided concerning fastening the filaments/fibre prior to molding. Hence, it is possible that the filaments/fibre to be easily detached from the brush strip.

Further, an U.S. Pat. No. 4,133,147 disclosed a method of producing a brush using a filament strip having stitched edges, wherein one edge is molded to an elastomeric base. However, it did not suggest the possibility of embedding one edge of the filament strip in the base by injection molding.

It is highly desirable to provide a method for preparation of a brush strip with reduced production cost and time. Further, a method for producing a brush strip which allows the brush strip to be assembled with desirable profile is highly welcomed.

SUMMARY OF THE INVENTION

One of the objects of the present invention is to offer a process for producing a brush strip having bristles of uniform thickness along the strip. Particularly, the bristles are produced from a bundle of fibers twisted continuously in alternating directions, wherein adjacent loops on one side are cut.

Another object of the present invention is to provide a process for producing a brush strip with one end of its bristles encapsulated by a plastic material. The bristles firmly embedded in the plastic material, hence preventing the detachment of the bristles from the brush strip.

Yet another object of the present invention is to present a process for producing a brush strip with one end of its bristles overmolded using injection molding method.

At least one of the preceding objects is met, in whole or in part, by the invention, in which the embodiment of the invention describes a process for producing a brush strip, comprises the steps of arranging a plurality of aligned monofilament fibers transversely in a sinusoidal configuration to form a body portion with fibers arranged in parallel and two looped ends; applying at least one row of stitching across the body portion towards one end, wherein the stitching is such as loop around groups of fibers to divide the body portion into separate bundles; overmolding the stitched end of the bundles with a thermoplastic polymeric material; and trimming the non-overmolded end of the body portion to create tufts of bristles.

Preferably, the fibers are wound such that adjacent loops are closely aligned and the body portion is rectangular.

The monofilament fibers comprise any one or a combination of electrically conductive and non-conductive fibers. Conductive fibers may include silver, copper, brass, phosphor bronze, stainless steel and carbon fibers. Non-conductive fibers may be natural fibers and synthetic fibers such as cotton, flax, hemp, wool, silk, fur, glass, mineral, cellulose, viscose, modal, acetate, polyamide, polyester, phenol formaldehyde, polyvinyl chloride, acrylic, polyethylene, polypropylene, polyurethane, or elastolefin fibers.

The stitching may comprise loop, chain or locked stitches. It may be performed using yarn or thread made of cotton, wool, rayon, polypropylene, polyester, or polyamide.

In another embodiment of the present invention, stitching is applied towards both ends.

In the preferred embodiment of the present invention, an adhesive agent is applied over the stitching prior to overmolding. The adhesive agent may be glue. It functions to bind the fibers to the stitches and secure the individual bundles.

Prior to overmolding, body portion may be divided into discrete length. The incised segment should fit into the molding cavity of the overmolding machine.

To carry out the overmolding, the stitched end of the bundles is first inserted into the molding cavity. The thermoplastic polymeric material is converted into its molten form and subsequently injected into the cavity. The thermoplastic material may be injected at pressure between 0.01 to 400 MPa.

The preferred thermoplastic polymeric material is polyamide, thermoplastic polyurethane (TPU), ethylene-vinyl acetate, polyethylene, polypropylene, thermoplastic elastomer (TPE) or any thermoplastic vulcanizate (TPV).

BRIEF DESCRIPTION OF THE DRAWINGS

For the purpose of facilitating an understanding of the invention, there is illustrated in the accompanying drawing the preferred embodiments from an inspection of which when considered in connection with the following description, the invention, its construction and operation and many of its advantages would be readily understood and appreciated.

DETAILED DESCRIPTION OF THE INVENTION

Figure 1:
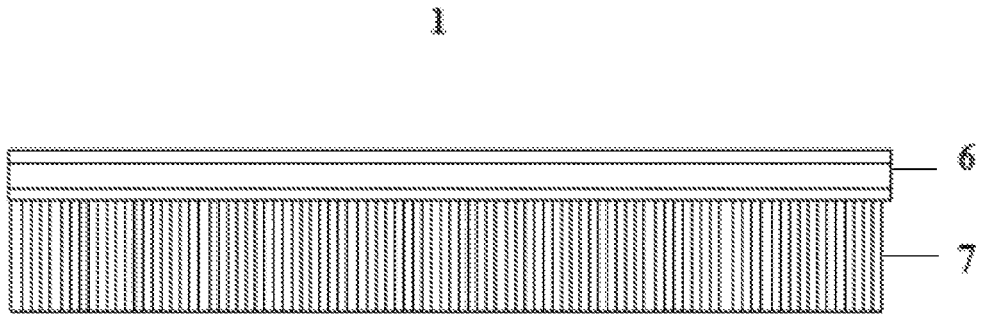
FIG. 1 is the front view of the brush strip.

One skilled in the art will readily appreciate that the present invention is well adapted to carry out the objects and obtain the ends and advantages mentioned, as well as those inherent therein. The embodiment described herein is not intended as limitations on the scope of the invention.

The present invention discloses a process for producing a brush strip 1, comprises the steps of arranging a plurality of aligned monofilament fibers 2 transversely in a sinusoidal configuration to form a body portion 3 with fibers arranged in parallel and two looped ends 4*a*, 4*b*; applying at least one row of stitching 5 across the body portion towards one end, wherein the stitching is such as loop around groups of fibers to divide the body portion 3 into separate bundles; overmolding the stitched end of the bundles with a thermoplastic polymeric material 6; and trimming the non-overmolded end of the body portion 2 to create tufts of bristles 7.

Figure 2:
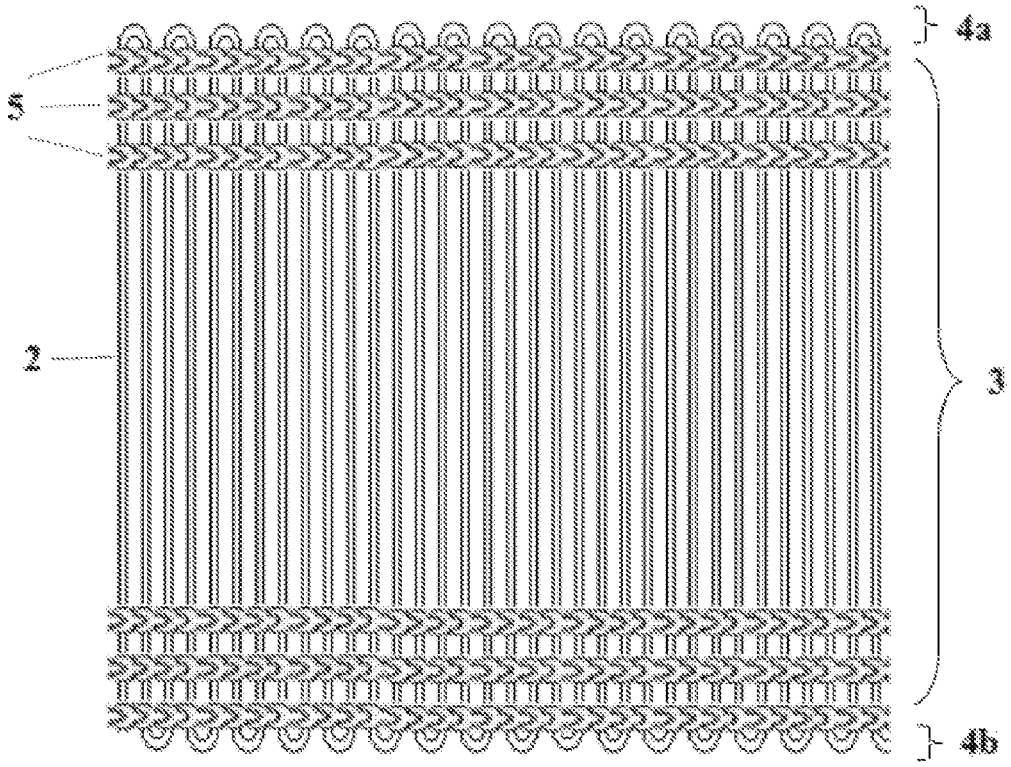
FIG. 2 illustrates the sinusoidal configuration of the fibers, wherein the fibers of the body portion are divided into separate bundles by rows of stitching.

As shown in FIG. 1, the brush strip 1 comprises monofilament fibers 2 having one end embedded in a thermoplastic material 6. In order to produce the brush strip as shown, a plurality of aligned monofilament fibers are arranged transversely in a sinusoidal configuration as shown in FIG. 2. The arranged fibers eventually form a body portion 3 and two ends 4*a*, 4*b*. Particularly, the body portion comprises fibers arranged in parallel. The ends comprise loops formed when the fibers are twisted 180° in alternating directions. More particularly, the adjacent loops are closely aligned. Further, it is preferable to level the loops at at least one end.

In the preferred embodiment of the present invention, the monofilament fibers 2 comprise any one or a combination of electrically conductive and non-conductive fibers. The choice of fibers used is dependent on the application of the brush strip. For instance, electrically conductive fibers can be used to dissipate any static charge on an electrically charged surface. Furthermore, the monofilament fibers can be of any thickness and color.

Electrically conductive fibers comprise metal fibers and carbon fibers. Examples of metal fibers include, but not limited to, silver, copper, brass, phosphor bronze, stainless steel, nickel, gold, and titanium fibers. In addition, non-conductive fibers coated with electrically conductive material can be used to dissipate static charge on a charged surface.

Preferably, electrically non-conductive fibers comprise fibers naturally occur in plant and animal. Plant-based fibers are cellulosic fibers which may be cotton, flax, hemp, or jute fibers. Examples of animal-based fibers may include protein fibers such as wool, silk and fur fibers.

Besides natural fibers, manufactured fibers such as regenerated and synthetic fibers are electronically non-conductive fibers. Regenerated fibers, made from wood pulp as raw material, comprise cellulose, viscose, modal and acetate fibers. There are several types of synthetic fibers, including, but not limited to, polyamide, polyester (e.g. polyethylene terephthalate, polybutylene terephthalate, and polytrimethylene terephthalate), phenol formaldehyde, polyvinyl chloride, olefin, polyolefin (e.g. polyethylene and polypropylene), polyurethane, acrylic, aramid and elastolefin fibers. In another embodiment of the present invention, glass fibers and mineral fibers, such as ceramic fibers, can be used as non-conductive fibers.

Accordingly, the fibers of the body portion 3 are divided into separate bundles by stitching 5 applied across the body portion. Particularly, the stitches encompass the fibers of the body portion such that the fibers are closely adhered to each other.

In the preferred embodiment of the present invention, the stitches in a row of stitching are interlinked, hence holding the individual bundles tightly and maintaining the sinusoidal configuration of the fibers. The stitches may be loop, chain or locked stitches. More than one type of stitches may be used in one or separate rows of stitching.

Particularly, stitching 5 is applied across the body portion towards the ends 4*a*, 4*b*. In the preferred embodiment of the present invention, at least one row of stitching is applied towards one looped end. In another preferred embodiment of the present invention, at least one row of stitching is applied at both ends as to enable easy handling of the wound bundle.

Preferably, stitching 5 is performed using yarn or thread made of cotton, wool, rayon, polypropylene, polyester or polyamide. The number of yarn or thread used may vary from row to row.

In another preferred embodiment of the present invention, an adhesive agent is applied over the stitching 5 prior to overmolding. The adhesive agent may be glue. It functions to bind the fibers 2 to the stitches and secure the individual bundles. It is preferable to apply the adhesive agent on at least one row of stitching that is closest to the ends.

In another embodiment of the present invention, the body portion 3 may be cut transversely and divided into a discrete length before being subjected to overmolding. In this specification, the length of the body portion refers to the distance from loop to loop on one end. Preferably, the length of the cut body portion is shorter than the length of the mold of the overmolding device, such that it fits into the mold.

Figure 3:
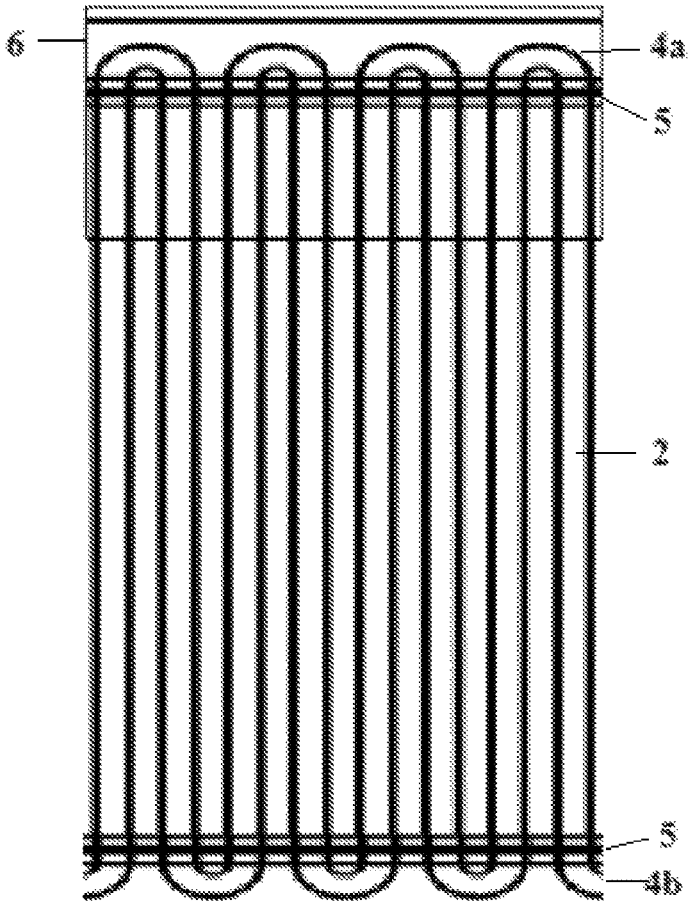
FIG. 3 is the cross-sectional view of the body portion with one looped end overmolded with the thermoplastic polymeric material.
Figure 4:
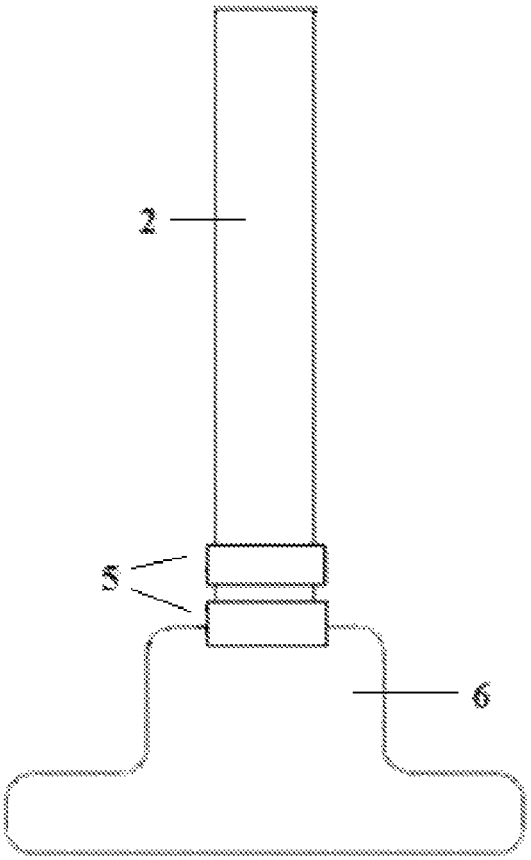
FIG. 4 is the side view of the brush strip having a flatheaded overmolded end.

As set forth in the preceding description, one stitched end is overmolded such that it is firmly embedded in the overmolding material. FIG. 3 shows that the the stitched end of the body portion is enclosed by the overmolding material. In another embodiment of the present invention, at least one row of stitchings is not overmolded as indicated in FIG. 4.

The preferred overmolding material comprises thermoplastic polymeric material 6. Examples of thermoplastic material include, but not limited to, polyamide, thermoplastic polyurethane (TPU), ethylene-vinyl acetate, polyethylene, polypropylene, thermoplastic elastomer (TPE) or any thermoplastic vulcanizate (TPV). Preferably, the thermoplastic polymeric material in its molten state, consequently allowing it to be introduced into the molding cavity at pressure not exceeding 400 MPa.

In accordance with the preferred embodiment of the present invention, the overmolding is conducted by heating the thermoplastic material 6 to its melting point in the overmolding device before it is injected into the molding cavity where into the stitched end of the body portion 3 is inserted. Preferably, the molten thermoplastic material 6 is injected continuously into the molding cavity at pressure between 0.01 to 400 MPa for 10 to 50 s.

The mold of the overmolding device may be of any configuration and shape. FIG. 3 illustrates a brush strip 1 having a flatheaded overmolded end. Preferably, the mold has a temperature between 15 to 25° C. so as to accelerate cooling of the thermoplastic material 6. The mold may be held in position inside the molding device by a clamping unit exerting clamping pressure between 50 to 450 ton on the mold.

The overmolded end of the body portion is removed from the molding cavity after the thermoplastic material cools down and solidifies. The loops at the non-overmolded end of the body portion are either slit or removed to produce the bristles of the brush strip. The brush strip may have evenly or unevenly cut bristles.

Examples

An example is provided below to illustrate different aspects and embodiments of the invention. The example is not intended in any way to limit the disclosed invention, which is limited only by the claims.

As shown in FIG. 2, carbon monofilament fibers are wound sinusoidally to form a rectangular body portion having two looped end, wherein the loops on the ends are closely aligned. The looped ends are respectively fastened by three rows of chain stitching. Glue is then applied to the stitches of the monofilament fiber.

Prior to overmolding, the body portion is cut into segments of discrete length. One of the stitched ends of the segment is inserted into the molding cavity of the overmolding device. As indicated in FIG. 3, the stitchings lie within the molding cavity.

During the overmolding, molten thermoplastic elastomer-based (TPE-based) material is injected into the molding cavity. It is injected into the cavity for 20 to 50 s to completely fill the cavity and encapsulate the part of the carbon fibers exposed in the cavity. The molten TPE-based material cools down when it comes into contact with the carbon fibers.

After the polyethylene-based material solidifies, the overmolded end of the body portion is ejected from the cavity. Loops and stitchings at the non-overmolded end of the body portion are removed to produce a brush strip having bristles of uniform length as shown in FIG. 1.

The invention claimed is:

1. A process for producing a brush strip configured to assemble with multiple profiles, the process comprising:

arranging a plurality of aligned monofilament fibers transversely in a sinusoidal configuration to form a body portion with fibers arranged in parallel and two looped ends;

applying at least one row of stitching across the body portion towards one end, wherein the stitching is such as loop around groups of fibers to divide the body portion into separate bundles;

overmolding the stitched end of the bundles with a thermoplastic polymeric material; and trimming the non-overmolded end of the body portion to create tufts of bristles, wherein the overmolding is carried out by inserting the stitched end of the bundles into a molding cavity injected with the thermoplastic polymeric material, in a molten form, at pressure between 0.01 to 400 MPa, wherein cooling of the thermoplastic material is accelerated by maintaining temperature of mold between 15 to 25° C. thereby enabling brush with multiple profiles.

2. The process according to claim 1, wherein the stitching comprises loop, chain or locked stitches.

3. The process according to claim 1, wherein stitching is applied towards both ends.

4. The process according to claim 1, further comprising a step of applying an adhesive agent over the stitching prior to overmolding.

5. The process according to claim 4 further comprising a step of dividing the body portion into discrete length prior to overmolding.

6. The process according to claim 1, wherein the fibers comprise a combination of electrically conductive and electrically non-conductive fibers.

7. The process according to claim 6, wherein the fibers are conductive fibers and are silver, copper, brass, phosphor bronze, stainless steel, or carbon fibers.

8. The process according to claim 6, wherein the fibers are non-conductive fibers and are cotton, flax, hemp, wool, silk, fur, glass, mineral, cellulose, viscose, modal, acetate, polyamide, polyester, phenol formaldehyde, polyvinyl chloride, acrylic, polyethylene, polypropylene, polyurethane, or elastolefin fibers.

9. The process according to claim 1, wherein the stitching is performed using yarn or thread made of cotton, wool, rayon, polypropylene, polyester, or polyamide.

10. The process according to claim 1, wherein the thermoplastic polymeric material is polyamide, thermoplastic polyurethane, ethylene-vinyl acetate, polyethylene, polypropylene, thermoplastic elastomer or any thermoplastic vulcanizate.

11. A brush strip produced according to the process of claim 1.

* * * * *